United States Patent [19]

Ishii et al.

[11] Patent Number: 4,974,562

[45] Date of Patent: Dec. 4, 1990

[54] OIL PUMP DEVICE OF AN ENGINE

[75] Inventors: Keisuke Ishii; Hitoshi Taguchi; Manabu Sudo, all of Tokyo, Japan

[73] Assignee: Fuji Jukogyo Kabushiki Kaisha, Tokyo, Japan

[21] Appl. No.: 451,180

[22] Filed: Dec. 15, 1989

[30] Foreign Application Priority Data

Dec. 27, 1988 [JP] Japan ..... 63-169852[U]

[51] Int. Cl.[5] ..... F02B 77/00

[52] U.S. Cl. ..... 123/198 C; 123/196 W; 415/111; 184/31

[58] Field of Search ..... 123/196 W, 198 C; 184/31; 417/423.14, 424.1; 415/110, 111, 112

[56] References Cited

U.S. PATENT DOCUMENTS 4,087,211 5/1978 Pochyly ..... 415/111
4,545,741 10/1985 Tomioka et al. ..... 415/112
4,664,228 5/1987 Hashigaki ..... 123/198 C
4,911,119 3/1990 Ohno et al. ..... 123/196 W

*Primary Examiner*—E. Rollins Cross
*Attorney, Agent, or Firm*—Beveridge, DeGrandi & Weilacher

[57] ABSTRACT

A lubricating oil pump device of an engine comprises an upper and a lower pump case and a rotary pumping mechanism of the internal-gear, one-tooth difference type housed within a housing formed between the upper and lower pump cases. Both the pump cases have oil reserving oil sumps formed therein, thereby to reserve some oil in the pump device even when the engine is stopped for a long period. Then, when the engine is restarted and the pumping mechanism operates, the oil thus reserved in the oil sumps is contacted by the moving pumping mechanism and is induced out to form oil films on the surfaces of the pump cases and of the pumping mechanism. Thus instant lubrication and sealing for effective suction are assured.

7 Claims, 4 Drawing Sheets

OIL PUMP DEVICE OF AN ENGINE

BACKGROUND OF THE INVENTION

The present invention relates generally to oil pumps and more particularly to an engine oil pump device capable of reserving oil therewithin even when the engine is stopped.

An example of oil pumps being used at present in engines such as vertical shaft engines is disclosed in Japanese Utility Model Appln. Laid-Open Publn. No. 192585/1986. The pump is a rotary pump of the so-called internal-gear, one-tooth difference type. In the oil pump, as installed, an internal-gear-impeller assembly or a pumping mechanism is horizontally supported on a vertical pump shaft. The pumping mechanism is disposed above the oil surface of the oil pan in some cases. In such a case, if the engine is stopped for a long period, the oil within the pump chambers will flow under the force of gravity toward the oil pan side. Then, when the engine is again started, the lubrication of the clearance between the upper and lower surfaces of the pumping mechanism and the pump housing will become poor. Furthermore, it will become impossible to rely fully on the sealing effect of these clearance.

As a consequence, seizing of the pumping mechanism is apt to occur. Another undesirable consequence is defective suction of oil at the next starting of the engine. Thus, the engine performance and its durability drop.

Furthermore, similar trouble and failures occur also when ample oil is not adhering to the above mentioned clearance at the time of initial assembly and disassembly and reassembly for maintenance.

SUMMARY OF THE INVENTION

It is an object of the present invention to provide an oil pump device of an engine. The oil pump device comprises essentially a pump case and an oil pumping mechanism housed horizontally within the pump case. The oil pump device is capable, even when the engine is stopped, of amply preserving the lubrication and oil suction sealing of the clearance between the upper and lower surfaces of the oil pumping mechanism and the pump case, thereby effectively preventing decline in the performance and durability of the engine.

According to the present invention there is provided an oil pump device of an engine of the above described construction in which device oil sumps or oil reserving chambers are formed in the bottom of the pump case and in the upper surface of the oil pumping mechanism. Thus some oil is reserved in the pump device even when the engine is stopped. When the engine is started and the oil pumping mechanism operates, the oil thus reserved in the oil sumps is contacted by the pumping mechanism and is induced out to form oil films on the surfaces of the pump case and of the pumping mechanism which define clearances therebetween.

The further features of the present invention will be more clearly understood from the following detailed description referring to the accompanying drawings.

DETAILED DESCRIPTION OF THE PREFERRED EMBODIMENTS

Figure 1:
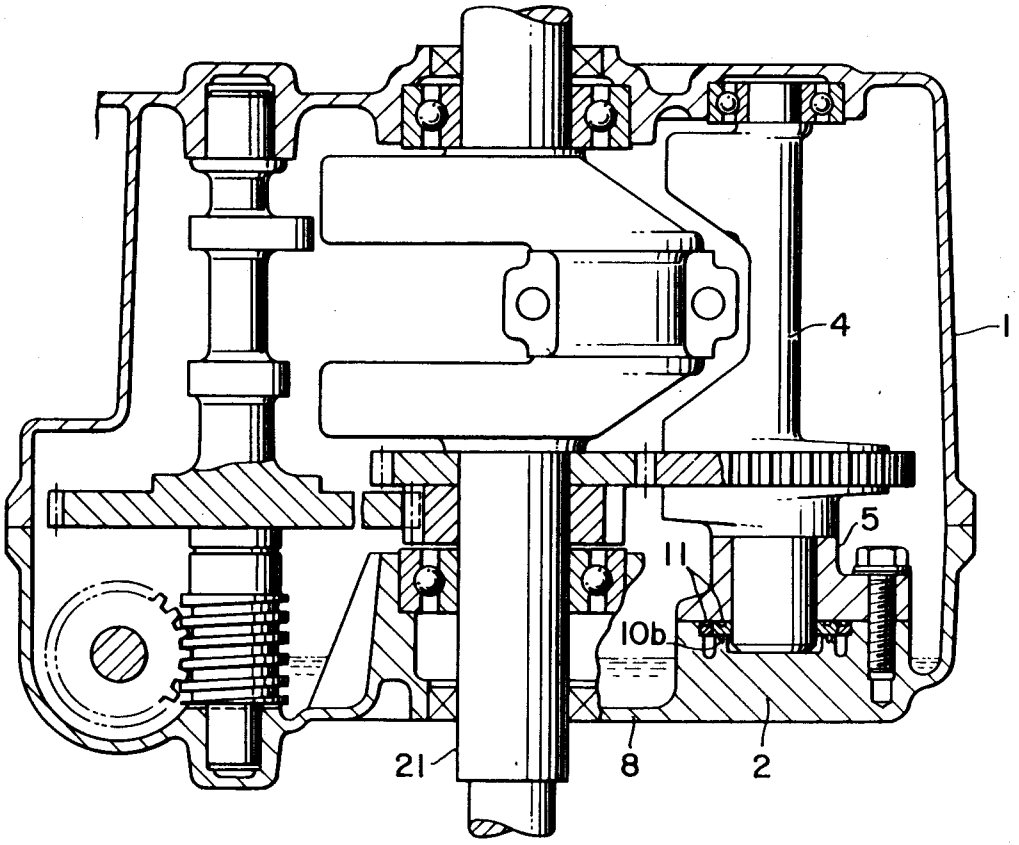
FIG. 1 is a side view of the part of an engine showing the installation therein of an embodiment of the oil pump device according to the present invention.
Figure 2:
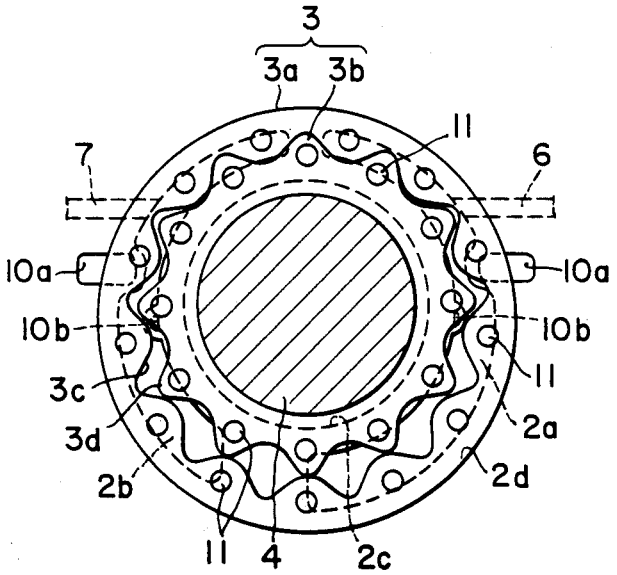
FIG. 2 is a plan view taken along the plane indicated by line II—II in FIG. 3 as viewed in the arrow direction.
Figure 3:
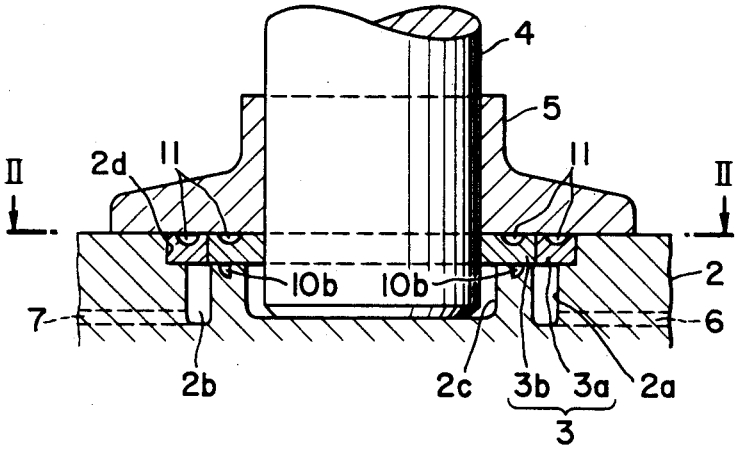
FIG. 3 is vertical section of the oil pump device.
Figure 4:
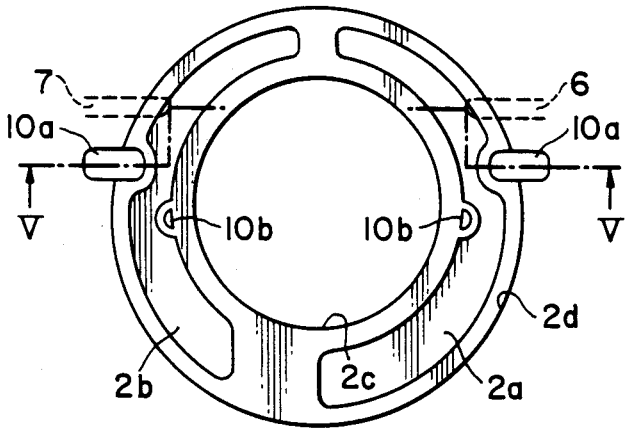
FIG. 4 is a plan view of the pump lower case.
Figure 5:
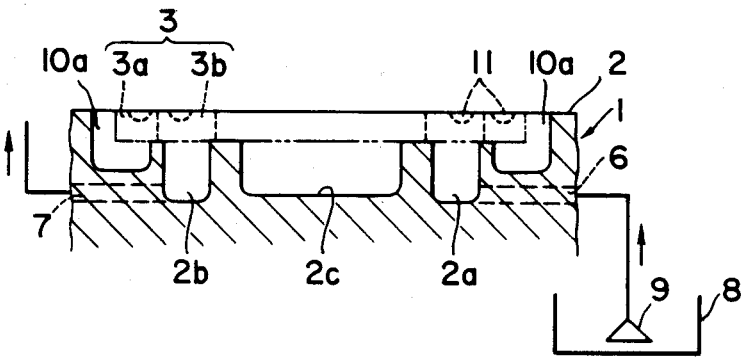
FIG. 5 is a vertical section taken along the plane indicated by line V—V in FIG. 4 as viewed in the arrow direction.

A preferred embodiment of the present invention will become understood from the following detailed description referring to the accompanying drawings.

Referring to the FIGS. 1 to 5, the example of the oil pump according to the present invention is installed in the lower part of a crankcase 1 of, for example, a vertical shaft engine 20. In the crankcase 1 a lower pump case 2 is formed like the projection. Within the lower pump case 2 is housed an internal gear-impeller mechanism or pump rotor assembly 3. The pump rotor assembly 3 comprises an internal gear or outer rotor 3*a* and an impeller or inner rotor 3*b*. The inner rotor 3*b* is fixed to the lower part of a vertical pump shaft 4. The pump shaft 4 is coupled through power transmission means such as gears to the crankshaft 21 of the engine 20.

An upper pump case 5 is fixed to the upper face of the lower pump case 2, thereby forming an enclosed housing 2*d*. The upper pump case 5 has a central bore through which the pump shaft 4 is rotatably passed. The upper faces of the outer rotor 3*a* and the inner rotor 3*b* are in sliding contact with the bottom face of the upper pump case 5.

In the bottom part of the lower pump case 2, below the pump rotor assembly 3, are formed a suction oil chamber 2*a* and a delivery oil chamber 2*b*. Both of the oil chambers 2*a* and 2*b* are of semicircular arcuate shape as viewed in plan view (see FIG. 2). The oil chambers 2*a* and 2*b* partly encompass a circular recess 2*c* on diametrically opposite sides thereof. The lower end of the pump shaft 4 extends into the circular recess 2*c*. A suction port 6 is formed horizontally through the lower pump case 2 to communicate with the suction oil chamber 2*a*. A delivery port 7 is formed horizontally through the lower pump case 2 to communicate with the delivery oil chamber 2*b*. An oil pan 8 provided at the bottom of the crankcase 1. Oil collected in the oil pan 8 is sucked up through an oil strainer 9 into the upstream end of the suction port 6. The delivery port 7 is connected by way of an oil gallery in flow communication with parts of the engine requiring lubrication.

On the outer sides of the suction and delivery oil chambers 2*a* and 2*b* of the lower pump case 2, a plurality of oil reserving troughs or oil sumps 10*a*, 10*a* are formed in the lower pump case 2. The inner end of each oil sump 10*a* lies in the rotation path of an internal gear teeth 3*c* of the outer rotor 3*a*. Furthermore, oil sumps 10*b*, 10*b* are formed in the inner parts of the lower pump case 2 at opposite positions of the inner sides of the oil chambers 2*a* and 2*b* in the rotation path of an external gear teeth 3*d* of the inner rotor 3*b*. In addition, a plurality of oil sumps 11 are formed at the same intervals around the outer and inner rotors 3*a* and 3*b* of the pump rotor assembly 3 in the upper surfaces thereof.

In the illustrated example, the lower pump case 2 is disposed above the oil surface of the above mentioned oil pan 8.

The example of the oil pump according to the present invention of the above described construction operates in the following manner.

When the engine 20 is started, the pump shaft 4 coupled to the engine crankshaft 21 rotates. Consequently, the inner rotor **3*b* coupled to the lower end of the pump shaft 4 and the outer rotor 3*a* rotate in the same direction (the clockwise direction as viewed in FIG. 2**).

As a consequence, the areas between the external gear teeth **3*d* of the inner rotor 3*b* and the internal gear teeth 3*c* of the outer rotor 3*a* vary. The oil into the suction oil chamber 2*a* is thus sucked in the direction in which these areas progressively expand. At the same time, the oil thus sucked in is discharged toward the delivery oil chamber 2*b*** in the direction in which the areas decrease.

When the oil in the suction oil chamber **2*a* is thus subjected to suction, the oil accumulated in the oil pan 8 is drawn up through the oil strainer 9 and the suction port 6 and flows into the suction oil chamber 2*a*. When the oil is discharged into the delivery oil chamber 2*b*, the oil then flows through the delivery port 7** and through an oil gallery (not shown) and is supplied to parts of the engine requiring lubrication.

When the engine stops, the rotation of the pump rotor assembly 3 stops. Then the oil accumulated in the suction oil chamber **2*a* and the delivery oil chamber 2*b* communicative therewith of the lower pump case 2 flows out with the passage of time through the suction port 6 and the oil strainer 9 into the oil pan 8. Almost all of the oil thus flows out of the oil chambers 2*a* and 2*b* when the engine is stopped for a long time. However, oil still remains in reserved state in the oil sumps 10*a*, 10*b* and 11 formed independently of the two oil chambers 2*a* and 2*b***.

Then, the pump rotor assembly 3 is thereby rotated when the engine 20 is restarted after it has been stopped for a long period. The oil accumulated in the oil sumps **10*a* and 10*b* contacts the bottom surfaces of the outer and inner rotors 3*a* and 3*b* and the surfaces of their teeth 3*c* and 3*d* and is thus induced out. This oil thereupon forms lubricating oil films on the surfaces of the clearance between the outer and inner rotors 3*a* and 3*b* and the lower pump case 2**.

Furthermore, oil is also accumulated in the oil sumps 11 formed in the upper surfaces of the outer and inner rotors **3*a* and 3*b*. This oil contacts the bottom surface of the pump upper case 5 and is thus induced out. In this manner, a lubricating oil film is formed on the surfaces of the clearance between the upper surfaces of the two rotors 3*a* and 3*b* and the bottom surface of the pump upper case 5**.

As a result, the upper and lower surfaces of the two rotors **3*a* and 3*b* are sealed by the above mentioned lubricating oil film. Therefore the oil suction operation of the pump rotor assembly 3 is improved. This may be considered to be analogous to pump priming. Furthermore this lubricating oil film effectively prevents seizing between the two rotors 3*a* and 3*b* and the upper and lower pump cases 2 and 5**.

Figure 6:
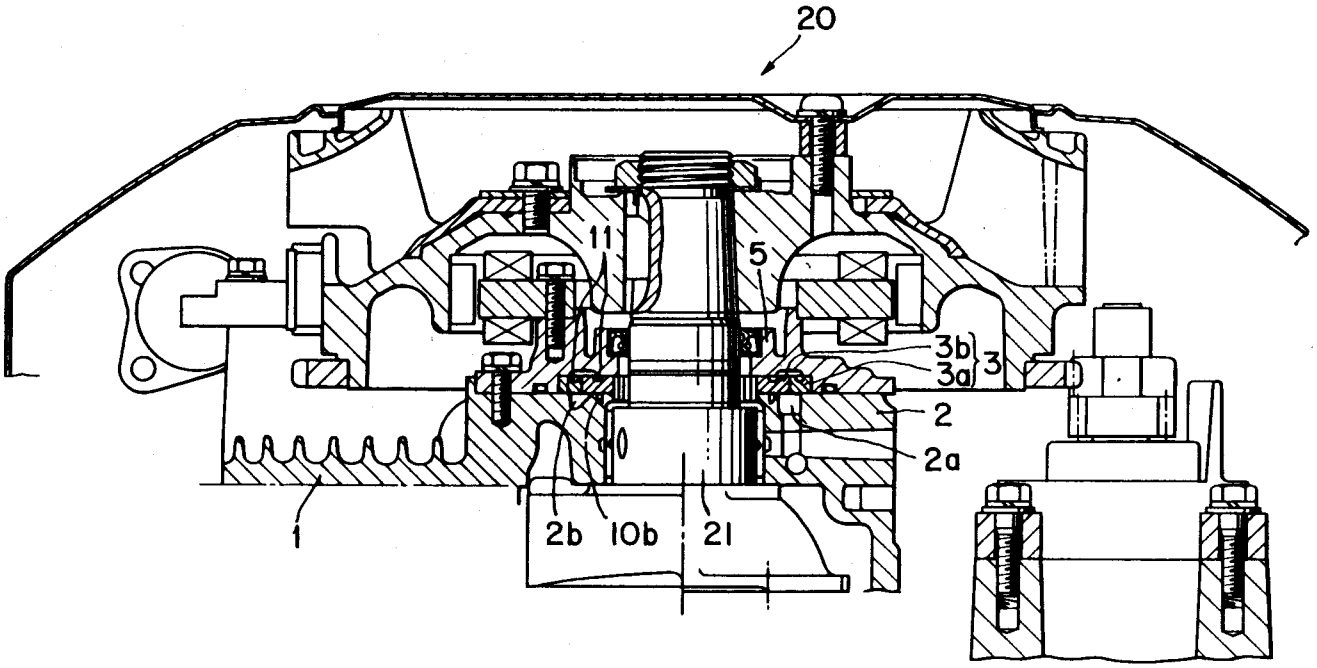
FIG. 6 is a side view of the upper part of an engine showing the installation therein of a second embodiment of the oil pump device according to the present invention.

Referring to FIG. 6, the second embodiment of the oil pump according to the present invention is installed in the upper part of a crankcase of a vertical shaft engine. Same numerals as those of the first embodiment indicate the same or similar to corresponding parts in the preceeding embodiment.

A significant feature of the oil pump device of the above described construction is that the provision of the oil sumps **10*a*, 10*b* and 11 does not give rise to a great contraction of the areas of the oil chambers 2*a* and 2*b***. Thus the pumping performance under normal operational conditions is not lowered.

The present invention is not limited to the details of the above described example. For instance, the oil pumping mechanism is not limited to that of a rotary pump of internal-gear type but may be of another type. Furthermore, the oil sumps may be formed, for example, in a continuous state or a non-continuous state around and on the rotors.

As described above, the present invention affords the following useful features. Oil sumps are formed in the bottom part of the pump case accommodating the oil pumping mechanism in a horizontal state and in the upper surface of the oil pumping mechanism. When the engine is restarted after being stopped, the oil accumulated in these oil sumps form lubricating oil films on the upper and lower surfaces of the oil pumping mechanism and on the surfaces of the parts of this mechanism and the pump case between which clearances are formed. Therefore excellent lubrication and sealing of these clearance parts is maintained. As a result, decrease in the performance and durability of the engine can be effectively prevented.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. An oil pump device of an engine having a crankcase, said oil pump device comprising:

a lower pump case formed in the crankcase;

an upper pump case fixed to the upper face of the lower pump case to form a pump housing therebetween;

rotors horizontally housed in the pump housing;

a suction oil chamber formed in the lower pump case to communicate with the pump housing;

a delivery oil chamber formed in the lower pump case to communicate with the pump housing;

first oil sumps formed in the upper surfaces of the rotors; and second oil sumps formed in the inner parts of the lower pump case, thereby, when the engine is stopped, reserving some oil for forming oil films on the parts of the upper and lower pump cases to ensure initial lubrication and suction sealing of the oil pump device at the restarting of the engine.

2. The oil pump device according to claim 1, wherein said rotors comprises an outer rotor having internal gear teeth and an inner rotor having external gear teeth.

3. The oil pump device according to claim 1, wherein said first oil sumps formed in the upper surfaces of the rotors are formed at the same intervals around the outer and inner rotors.

4. The oil pump device according to claim 1, wherein said suction and delivery oil chambers are connected in flow communication with a suction and a delivery ports.

5. The oil pump device according to claim 2, wherein said second oil sumps formed in the inner parts of the lower pump case are positioned in the rotation path of the external gear teeth of the inner rotor.

6. The oil pump device according to claim 2, further comprising:

third oil sumps formed in the lower pump case at the periphery of the outer rotor.

7. The oil pump device according to claim 6, wherein said third oil sumps are positioned in the rotation path of the internal gear teeth of the outer rotor.

* * * * *